US008024860B2

(12) United States Patent
Kanbe

(10) Patent No.: US 8,024,860 B2
(45) Date of Patent: Sep. 27, 2011

(54) METHODS FOR MANUFACTURING AN INK CARTRIDGE

(75) Inventor: Tomohiro Kanbe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 778 days.

(21) Appl. No.: 11/970,475

(22) Filed: Jan. 7, 2008

(65) Prior Publication Data

US 2009/0056128 A1 Mar. 5, 2009

(30) Foreign Application Priority Data

Aug. 31, 2007 (JP) ..... 2007-225742

(51) Int. Cl.
*B21D 53/76* (2006.01)
*B41J 2/175* (2006.01)

(52) U.S. Cl. ..... 29/890.1; 29/611; 29/830; 29/831; 29/832; 347/86

(58) Field of Classification Search ..... 29/890.1, 29/611, 464, 830, 831, 832; 216/27; 347/85, 347/86, 87, 107, 108, 54
See application file for complete search history.

(56) References Cited

U.S. PATENT DOCUMENTS

| | | | | |
|---|---|---|---|---|
| 5,325,119 | A * | 6/1994 | Fong | 347/86 |
| 5,448,818 | A * | 9/1995 | Scheffelin et al. | 347/86 |
| 6,053,607 | A * | 4/2000 | Kaplinsky et al. | 347/87 |
| 6,457,818 | B1 * | 10/2002 | Kurashima et al. | 347/71 |
| 6,648,452 | B2 * | 11/2003 | Ito | 347/54 |
| 7,152,965 | B2 * | 12/2006 | Ishizawa et al. | 347/86 |
| 2003/0184626 | A1 | 10/2003 | Sasaki et al. | |
| 2005/0057624 | A1 | 3/2005 | Hanaoka | |
| 2007/0070147 | A1 | 3/2007 | Hattori et al. | |

FOREIGN PATENT DOCUMENTS

| | | | |
|---|---|---|---|
| EP | 1693213 | A2 | 8/2006 |
| EP | 1772270 | A2 | 4/2007 |
| EP | 1792736 | A1 | 6/2007 |
| EP | 1886821 | A2 | 2/2008 |
| JP | 2007144808 | A | 6/2007 |

OTHER PUBLICATIONS

European Patent Office, European Search Report for European Patent Application No. EP08003696 (counterpart to above-captioned patent application), dated Jul. 3, 2008.

* cited by examiner

*Primary Examiner* — Derris H Banks
*Assistant Examiner* — Tai Nguyen
(74) *Attorney, Agent, or Firm* — Baker Botts L.L.P.

(57) ABSTRACT

A method for manufacturing an ink cartridge includes the step of connecting a film or a pair of films to a frame. The films and the frame define an ink chamber therein, and the ink cartridge includes the films and the frame. The method also includes the step of positioning a patterned member adjacent to the films. The patterned member includes a first pattern, and the first pattern includes a first portion and a second portion which is raised with respect to the first portion. Moreover, the method includes the step of forming a second pattern corresponding to the first pattern on the films by generating a pressure differential between a pressure inside the ink chamber and a pressure outside the ink chamber, in which the pressure differential draws the films into contact with the first pattern.

9 Claims, 13 Drawing Sheets

METHODS FOR MANUFACTURING AN INK CARTRIDGE

CROSS-REFERENCE TO RELATED APPLICATION

The present application claims priority from Japanese Patent Application No. JP-2007-225742, which was filed on Aug. 31, 2007, the disclosure of which is incorporated herein by reference in its entirety.

BACKGROUND OF THE INVENTION

1. Field of the Invention

The present invention relates generally to methods for manufacturing an ink cartridge comprising a film which defines at least a portion of an ink chamber.

2. Description of Related Art

A known ink cartridge is configured to be mounted to and removed from an inkjet recoding apparatus. The known ink cartridge has an ink chamber configured to store ink, and when the ink cartridge is mounted to the inkjet recording apparatus, ink is supplied from the ink chamber to the inkjet recording apparatus. The ink chamber is defined by a frame and a pair of films adhered to opposite side faces of the frame.

The frame has a substantially flat, hexahedron shape having six faces. The frame has openings formed through two opposing faces which have the largest area among the six faces, and the openings are covered and closed by a corresponding one of the films adhered to the frame. The frame also includes an ink supply opening configured to supply ink from the interior of the ink chamber to the exterior of the ink chamber, and an air intake opening configured to draw air into the ink chamber. When the ink cartridge is mounted to the inkjet recording apparatus, ink in the ink chamber is supplied to the inkjet recording apparatus through the ink supply opening, and air flows into the ink chamber through the air intake opening.

Ink droplets may adhere to an inner wall surface of the frame when ink is gradually consumed. The ink cartridge may have walls or ribs extending in the gravitational direction, and ink droplets may be guided downward along the walls or the ribs. Nevertheless, when at least a portion of ink chamber is defined by films, it is difficult to provide walls, ribs, or the like on the inner surfaces of the films. Consequently, ink droplets adhering to the inner surfaces of the films do not run downward, and a substantial amount of ink may remain on the inner surfaces of the films.

SUMMARY OF THE INVENTION

Therefore, a need has arisen for methods for manufacturing an ink cartridge which overcome these and other shortcomings of the related art. A technical advantage of the present invention is that an ink cartridge is manufactured, such that ink in the ink cartridge may be consumed efficiently.

According to an embodiment of the present invention, a method for manufacturing an ink cartridge comprises the step of connecting at least one film to a frame. The at least one film and the frame define an ink chamber therein, and the ink cartridge comprises the at least one film and the frame. The method also comprises the step of positioning a patterned member adjacent to the at least one film. The patterned member comprises a first pattern, and the first pattern comprises a first portion and a second portion which is raised with respect to the first portion. Moreover, the method comprises the step of forming a second pattern corresponding to the first pattern on the at least one film by generating a pressure differential between a pressure inside the ink chamber and a pressure outside the ink chamber, in which the pressure differential draws the at least one film into contact with at least a portion of the first pattern.

Other objects, features, and advantages of embodiments of the present invention will be apparent to persons of ordinary skill in the art from the following description of preferred embodiments with reference to the accompanying drawings.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1(A)-13, like numerals being used for like corresponding portions in the various drawings.

Figure 1B:
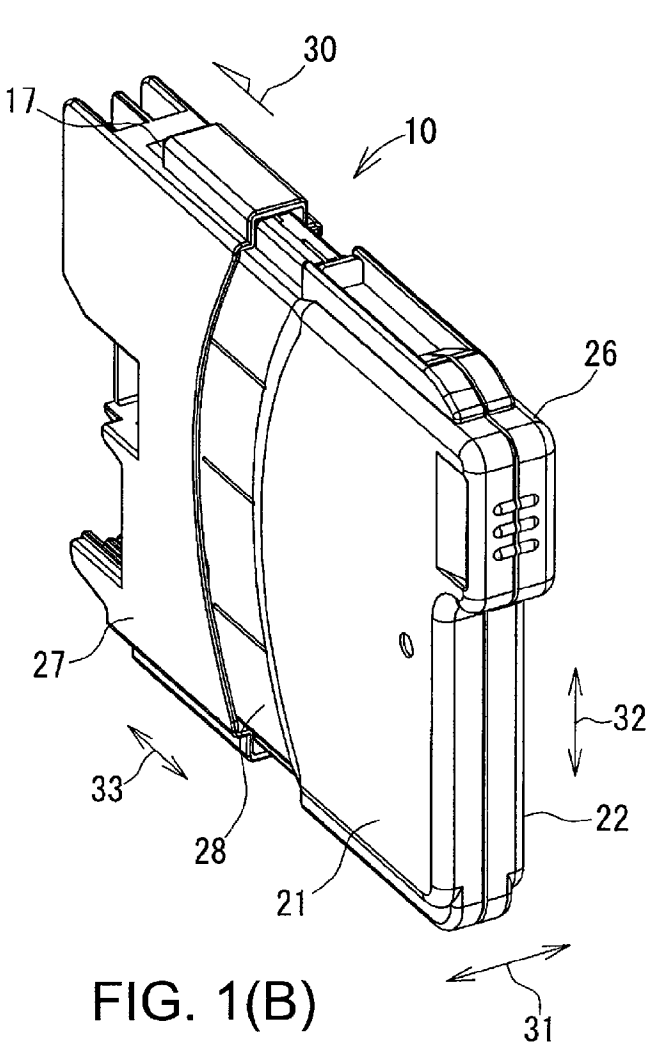
FIGS. 1(A) and 1(B) are a front-face perspective view and a rear-face perspective view of an ink cartridge, respectively, according to an embodiment of the present invention.
Figure 1A:
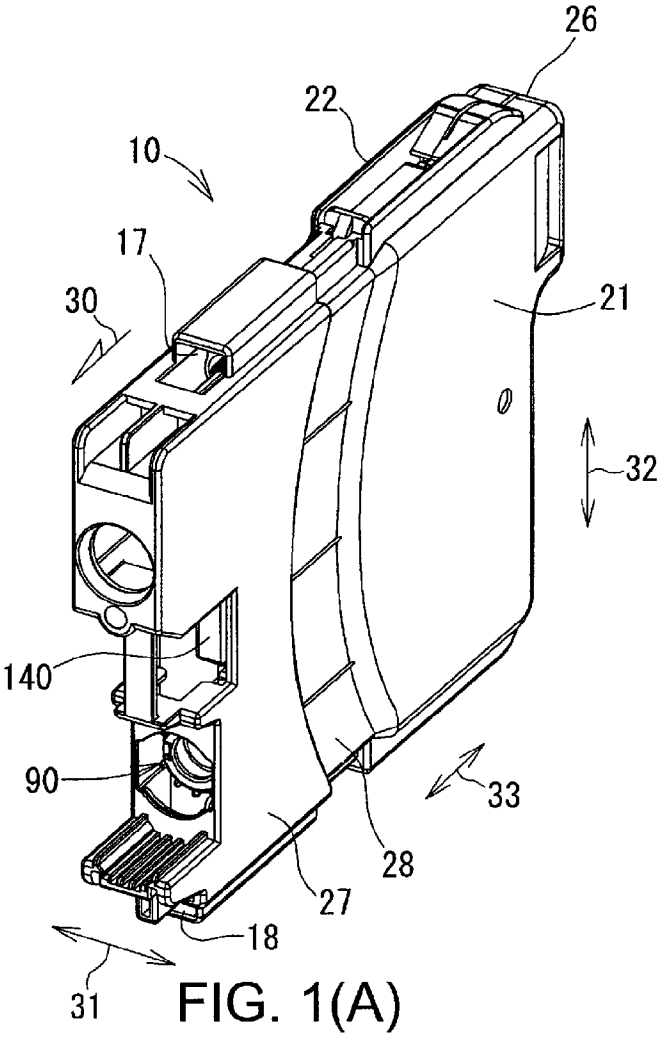

Referring to FIGS. 1(A) and 1(B), an ink cartridge 10, according to an embodiment of the present invention, is depicted. An image recording apparatus (not shown), e.g., an inkjet printer, may use ink cartridge 10 to form an image on a recording medium (not shown), e.g., paper. The ink cartridge 10 is configured to be mounted to and removed from a cartridge storage section (not shown) of the image recording apparatus. The ink cartridge 10 may be mounted to the cartridge storage section by inserting ink cartridge 10 in a direction indicated by an arrow 30 in FIG. 1. After the ink cartridge 10 is mounted in the cartridge storage section, ink stored in the ink cartridge 10 may be supplied to a recording head (not shown) of the image recording apparatus.

The ink cartridge 10 may have a substantially flat, hexahedron shape. A width of the ink cartridge 10, as indicated by an arrow 31, may be relatively short, and each of a height of the ink cartridge 10, as indicated by an arrow 32, and a depth of the ink cartridge 10, as indicated by an arrow 33, may be greater than the width of the ink cartridge 10.

Referring to FIGS. 1(A)-3(B), the ink cartridge 10 may comprise a container body 20, a housing 26, a movable member, e.g., a slider 27, and at least one resilient member, e.g., a pair of coil springs 23 and 24. The housing 26 and the slider 27 may enclose the container body 20.

The housing 26 is configured to protect the container body 20. Substantially the entirety of the container body 20 other than a front face 41 of the container body 20 may be covered by the housing 26. The housing 26 may comprise a first cover member 21 and a second cover member 22 configured to sandwich the container body 20 from the right and left in FIG. 2, respectively. In an embodiment, a pair of films 65 may be covered by the first cover member 21 and the second cover member 22.

The first cover member 21 is attached to a right side face 46 of the container body 20. The first cover member 21 may comprise a plurality of engaging claws 12 extending from an inner wall surface thereof, and the container body 20 may comprise a plurality of engaging grooves 13 formed therein. The plurality of engaging claws 12 may be fitted into the plurality of engaging grooves 13, respectively, such that the right side face 46 of the container body 20 is covered by the first cover member 21. Similarly, the second cover member 22 is attached to a left side face 45 of the container body 20. The second cover member 22 comprises a plurality of engaging claws (not shown) extending from an inner wall surface thereof, and the plurality of engaging claws are fitted in the plurality of engaging grooves 13, respectively, such that the left side face 45 of the container body 20 is covered by the second cover member 22.

The container body 20 may comprise an air communication valve mechanism 80, and an ink supply valve mechanism 90 positioned at the front face 41 thereof. The slider 27 is configured to protect the air communication valve mechanism 80 and the ink supply valve mechanism 90. The slider 27 may be coupled to the container body 20 by the coil springs 23 and 24 positioned therebetween, and is configured to move relative to the container body 20. An end of the coil spring 23 is received in a spring receiver 23A formed in an upper portion of the front face 41 of the container body 20, and an end of the coil spring 24 is received in a spring receiver 24A formed in a lower portion of the front face 41 of the container body 20. Engaging claws 15 and 16 extending from the front face 41 above the spring receiver 23A and below the spring receiver 24A, respectively, may be fitted in engaging holes 17 and 18 formed through the slider 27, respectively, such that the slider 27 covers the front face 41 of the container body 20 and a front portion 28 of the housing 26.

Figure 3A:
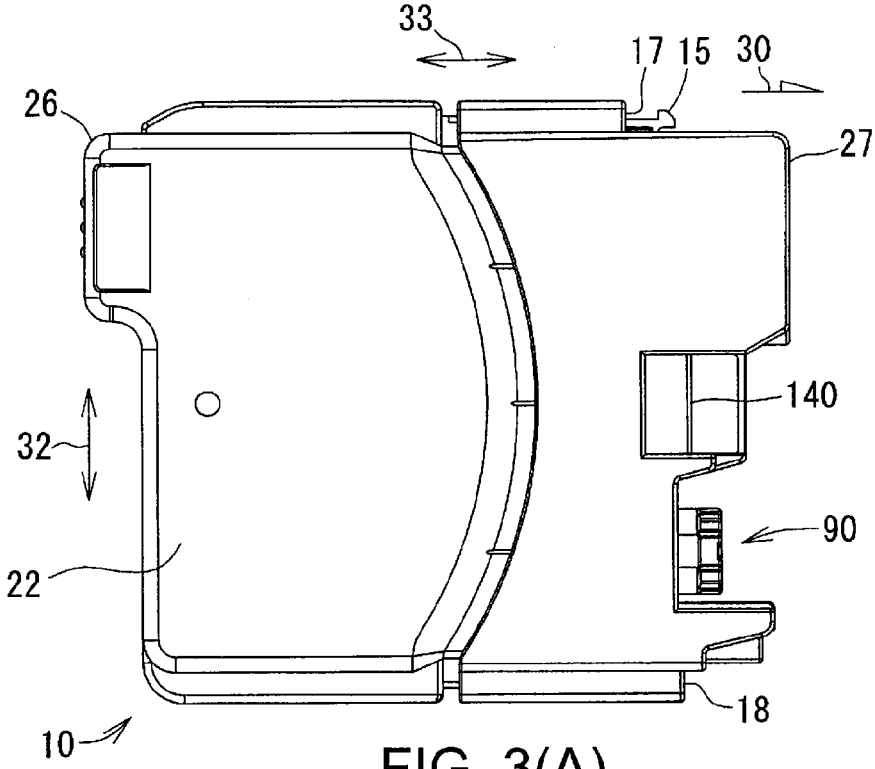
FIGS. 3(A) and 3(B) are side views of the ink cartridge of FIGS. 1(A) and 1(B), respectively, in which a movable member, such as a slider, is in a second position and a first position, respectively.
Figure 3B:
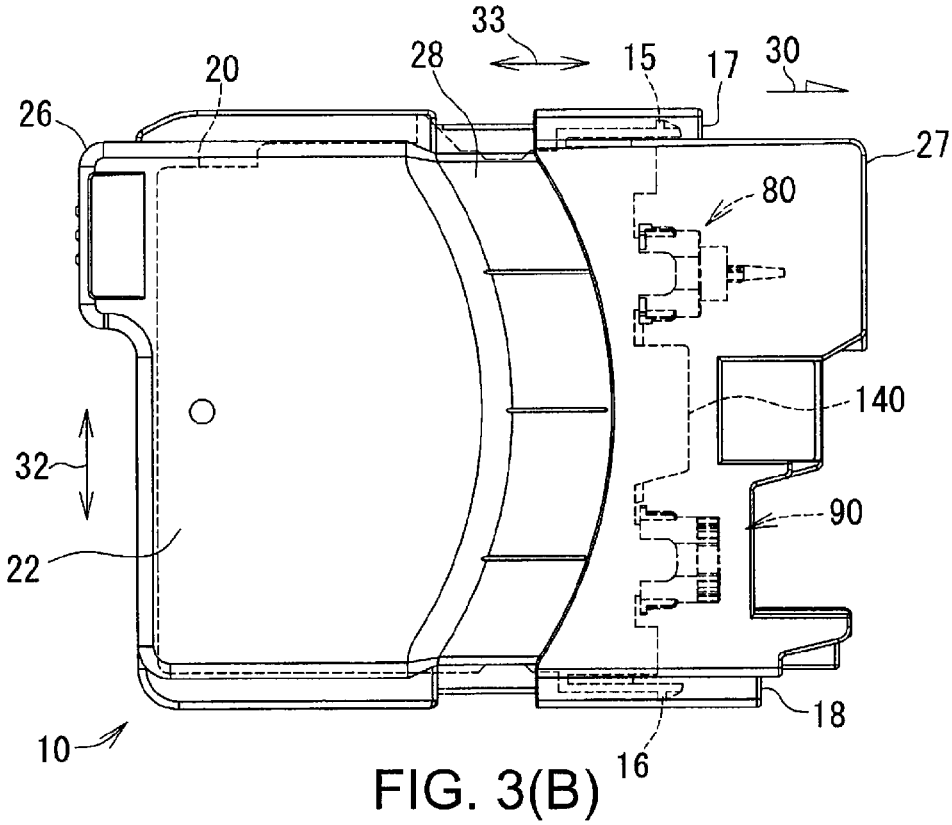
Figure 4:
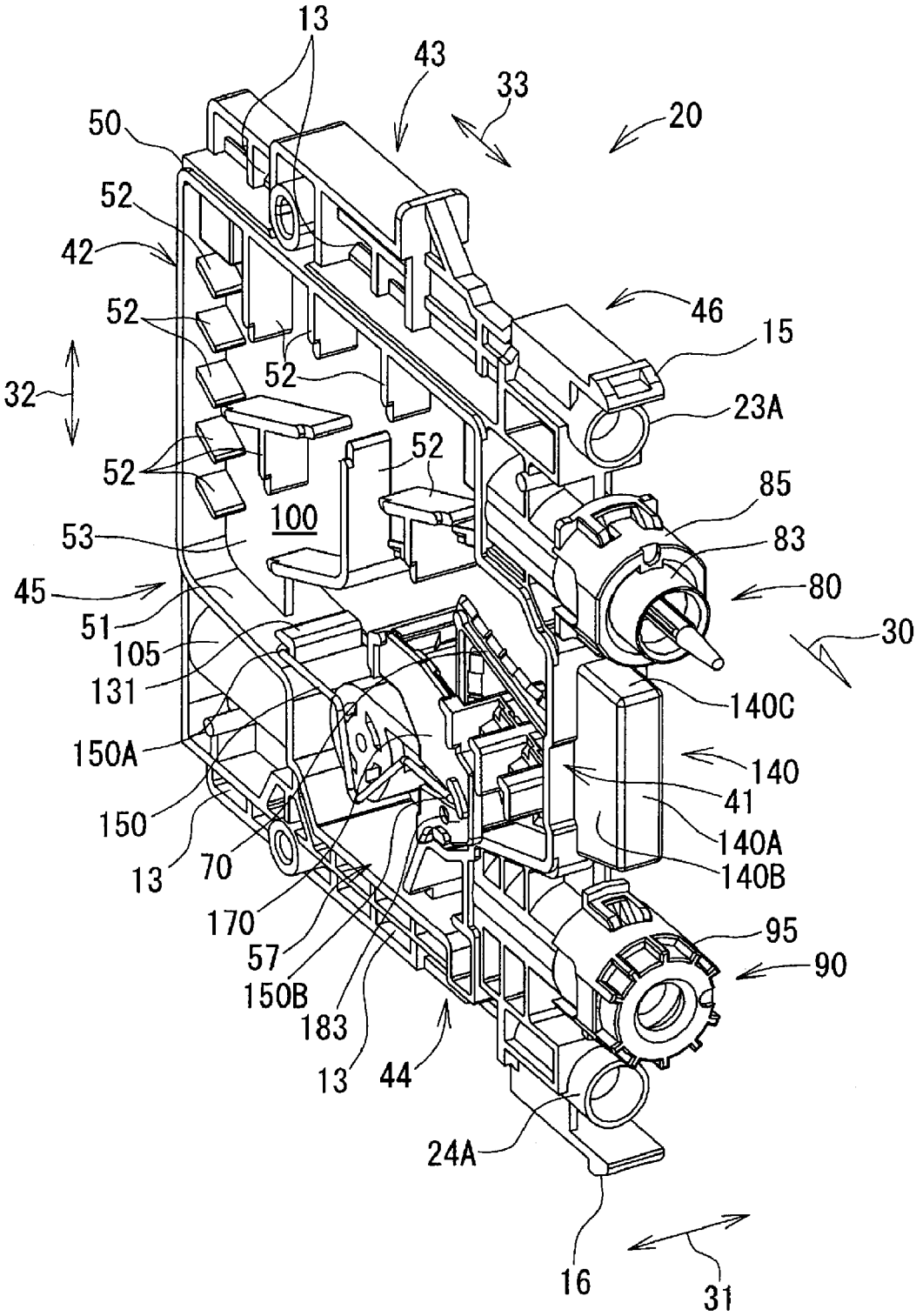
FIG. 4 is a perspective view of a container body, according to an embodiment of the present invention

The slider 27 may be configured to contact and slide on the front portion 28 of the housing 26 between a first position and a second position in the depth direction, as indicated by the arrow 33, when coil springs 23 and 24 expand and contract. When the slider 27 is at the second position, as depicted in FIG. 3(A), the slider 27 is positioned closer to the front face 41 of the container body 20 than when the slider 27 is in the first position, and when the slider 27 is at the first position, as depicted in FIG. 3(B), the slider 27 is positioned further from the front face 41 of the container body 20 than when the slider 27 is in the second position. When a predetermined amount of force greater than a biasing force of the coil springs 23 and 24 is applied to the slider 27, the slider 27 moves from the first position to the second position. When the slider 27 is in the second position, the ink supply valve mechanism 90 extends outside the slider 27 via an opening formed through the slider 27. When the predetermined amount of force is released from the slider 27, the slider 27 subsequently moves from the second position to the first position, the ink supply valve mechanism 90 is positioned within the slider 27.

Referring to FIGS. 4-7, the container body 20 may have a substantially flat, hexahedron shape having the front face 41, a rear face 42 opposite the front face 41, a top face 43, a bottom face 44 opposite top face 43, the left side face 45, and the right side face 46 opposite the left side face 45. Each of the top face 43 and the bottom face 44 is connected to the front face 41 and the rear face 42, and each of the left side face 45 and the right side face 46 is connected to the front face 41, the rear face 42, the top face 43, and the bottom face 44. Moreover, the area of the left side face 45 and the area of the right side face 46 each are greater than each of the area of the front face 41, the area of the rear face 42, the area of the top face 43, and the area of the bottom face 44.

The container body 20 may comprise a frame 50, a pivotable member 70, a supporting member, e.g., a supporting block 170, a protecting member 150, the air communication valve mechanism 80, the ink supply valve mechanism 90, and the pair of films 65. The frame 50 defines the six faces 41-46 of the container body 20, such that the six faces 41-46 of the container body 20 correspond to six faces of the frame 50.

The frame 50 may comprise a translucent resin material, e.g., a transparent material or a semi-transparent material, and light may pass therethrough. In this embodiment, the frame 50 may be manufactured by injection-molding polypropylene. Alternatively, the frame 50 may be manufactured by injection-molding polyacetal, nylon, polyethylene, or the like.

The frame 50 may comprise an outer peripheral wall 51 and a plurality of inner walls or a plurality of inner ribs 52. The inner walls or inner ribs 52 are positioned inside the outer peripheral wall 51. The outer peripheral wall 51 and the inner walls or inner ribs 52 may be integral, and may define the frame 50. The outer peripheral wall 51 and the inner walls or inner ribs 52 extend from the left side face 45 to the right side face 46 of the frame 50. The outer peripheral wall 51 may have a substantially square or rectangular perimeter extending along the front face 41, the top face 43, the rear face 42, and the bottom surface 44 defining a space in the interior thereof. Accordingly, openings 57 are formed on the left side face 45 and the right side face 46, respectively, of the frame 50, such that the left side face 45 and the right side face 46 of the frame 50 are opened.

The pair of films 65, e.g., translucent films, may be connected to, e.g., adhered to, the side faces 45 and 46, respectively, of the frame 50 via an adhesion method, e.g., a thermal adhesion method. More specifically, the pair of films 65 may be adhered to both ends of the outer peripheral wall 51 in the width direction 31. The openings 57 may be covered and closed by the pair of films 65, such that the frame 50 and the pair of films 65 define an ink chamber 100 configured to store ink therein. Alternatively, a container-shaped frame which is opened on the right side face 46 may be used instead of the frame 50. In this case, the ink chamber 100 is defined by the film 65 adhered to the right side face 46 of the container-shaped frame.

The frame 50 may comprise a partitioning member, e.g., a partitioning plate 53, extending from the outer peripheral wall 51, which may partition an upper space of the ink chamber 100 at the center in the width direction 31. The inner walls or inner ribs 52 extend from the outer peripheral wall 51 or the partitioning plate 53. The pair of films 65 also may be adhered to the inner walls or inner ribs 52 at both ends thereof in the width direction 31. Consequently, the inner walls or inner ribs 52 may restrict the ability of the pair of films 65, the first cover member 21, and/or the second cover member 22 to move inward, such that the inner walls or inner ribs 52 may limit an amount of deformation of the pair of films 65. A lower portion of the ink chamber 100, e.g., a space 102 below the partitioning panel 53, may not be partitioned in the width direction 31 and may extend from the left side face 45 to the right side face 46, such that the pivotable member 70 and the supporting block 170 are positioned therein.

In an embodiment, each of the pair of films 65 may comprise a plurality of layered, synthetic resin films. For example, each of the pair of films 65 may comprise three layers. The innermost layer may comprise a polypropylene, and may comprise the same material as the frame 50. The innermost layer of the pair of films 65 may be adhered to the frame 50. The outermost layer may comprise a polyethylene terephthalate, and the layer sandwiched by the innermost layer and the outermost layer may comprise a nylon. In another embodiment, each of the pair of films 65 may comprise a metal foil sandwiched by synthetic resins. In yet another embodiment, each of the pair of films 65 may comprise a pulp, a metal, or a natural resin.

The frame 50 may comprise a rib 74 positioned at a right-side face 46 side of the outer peripheral wall 51, such that the rib 74 is positioned adjacent to a corner between the front face 41 and the bottom face 44. A cylindrical tube 67 extends from the rib 74 towards the left side face 45. A shaft 77 having a column shape may have a first end fitted into the cylindrical tube 67, and a second end which is supported by the supporting block 170. The shaft 77 extends through a shaft hole 78 formed through the pivotable member 70.

The frame 50 may comprise a cylindrical ink introduction chamber 105 formed in the rear face 42 of the frame 50 adjacent to the lower end of the rear face 42. The ink introduction chamber 105 extends from the rear face 42 towards the ink chamber 100. The ink introduction chamber 105 is configured to be in fluid communication with the ink chamber 100. Ink is introduced into the ink chamber 100 through the ink introduction chamber 105 during the manufacturing process of the ink cartridge 10.

The frame 50 may comprise a translucent portion 140 positioned at the front face 41 and extending away from the ink chamber 100. An amount of ink stored in the ink chamber 100 may be optically or visually detected via the translucent portion 140. The translucent portion 140 may be integral with frame 50, and may comprise the same material as frame 50, e.g., the translucent portion 140 may comprise a translucent resin material which allows light to pass therethrough.

The translucent portion 140 may project outward from a center portion of front face 41 of the frame 50 away from the ink chamber 100. The translucent portion 140 may comprise five rectangular walls and have a substantially a hollow box shape. For example, the translucent portion 140 may comprise a front wall 140A, a pair of side walls 140B, a top wall 140C, and a bottom wall 140D. The front wall 140A extends parallel to the front face 41 and is separated from the front face 41 by a predetermined distance. The pair of side walls 140B are connected to the front face 41 and the front wall 140A, the top wall 140C is connected to top ends of the front wall 140A and the side walls 140B, and the bottom wall 140D is connected to bottom ends of the front wall 140A and the side walls 140B. Moreover, the width of the front wall 140A is less than the width of the front face 41. The translucent portion 140 is configured to receive light emitted from an optical sensor, e.g., a photo interrupter. When ink cartridge 10 is mounted to the image forming apparatus, a light emitting portion of a photo interrupter may face one of the side walls 140B and a light receiving portion of the photo interrupter may face the other of the side walls 140B. The light emitted from the light emitting portion of the photo interrupter may pass through the side walls 140B and reach the light receiving portion of the photo interrupter.

The translucent portion 140 may have an inner space 142 formed therein, which is defined by the front wall 140A, the side walls 140B, the top wall 140C, and the bottom wall 140D of the translucent portion 140. The inner space 142 is configured to be in fluid communication with the interior of the ink chamber 100. An indicating portion 72 of the pivotable member 70 may be configured to move within the inner space 142 between an upper position and a lower position based on an amount of ink in the ink chamber 100.

When the ink cartridge 10 is mounted to the image forming apparatus, the air communication valve mechanism 80 is positioned above the translucent portion 140. The air communication valve mechanism 80 is configured to selectively open and close an opening 81 formed through an upper portion of the front face 41 of the frame 50, such that air communication valve mechanism 80 selectively allows and prevents fluid communication between the interior of the ink chamber 100 and the exterior of the ink chamber 100 via the opening 81. The air communication valve mechanism 80 may comprise a valve member 87, an urging member, e.g., a spring 86, a stopper 83, and a cap 85.

The stopper 83 has an opening formed therethrough. The stopper 83 is partially positioned in the opening 81, but does not close the opening 81 completely because the opening is formed through the stopper 83. The valve member 87 is configured to move between an opened position in which the valve member 87 is separated from the stopper 83, and a closed position in which the valve member 87 contacts the stopper 83. When the valve member 87 is positioned in the opened position, the opening of the stopper 83 is not closed by the valve member 87, such that the opening 81 is opened. When the valve member 87 is positioned in the closed position, the opening of the stopper 83 is closed, such that the opening 81 is closed. The valve member 87 is resiliently urged by the spring 86 toward the stopper 83, such that the valve member 87 is in the closed position unless a force substantially opposite and greater than the biasing force of the spring 86 is applied to the valve member 87. Alternatively, the opening 81 may be covered with a film instead of using the atmospheric air communication valve mechanism 80.

When the ink cartridge 10 is mounted to the image forming apparatus, the ink supply valve mechanism 90 is positioned below the translucent portion 140. The ink supply valve mechanism 90 may be configured to selectively open and close an opening 91 formed through a lower portion of the front face 41 of the frame 50, such that the ink supply valve mechanism 90 selectively allows and prevents fluid communication between the interior of the ink chamber 100 and the exterior of the ink chamber 100 via the opening 91. The ink supply valve mechanism 90 may comprise a valve member 97, a spring 96, a spring receiver 94, a stopper 93, and a cap 95. The stopper 93 has an opening formed therethrough. The stopper 93 is partially positioned in the opening 91, but does not close the opening 91 completely because the opening is formed through the stopper 93. The valve member 97 is configured to move between an opened position in which the valve member 97 is separated from the stopper 93, and a closed position in which the valve member 97 contacts the stopper 93. When the valve member 97 is positioned in the opened position, the opening of the stopper 93 is not closed by the valve member 97, such that the opening 91 is opened. When the valve member 97 is positioned in the closed position, the opening of the stopper 93 is closed, such that the opening 91 is closed. The valve member 97 is resiliently urged by the spring 96 toward the stopper 93, such that the ink supply valve mechanism 90 is in the closed position unless a force substantially opposite and greater than the biasing force of the spring 96 is applied to the valve member 97. When the ink cartridge 10 is mounted to the image recording apparatus, the valve member 97 is pushed by a tube of the image recording apparatus against the biasing force of the spring 96, and the opening 91 is opened. Consequently, ink in the ink chamber 100 is allowed to flow from the opening 91 to the image recording apparatus via the tube. In another embodiment, the opening 91 may be formed through the bottom face 44.

Figure 5:
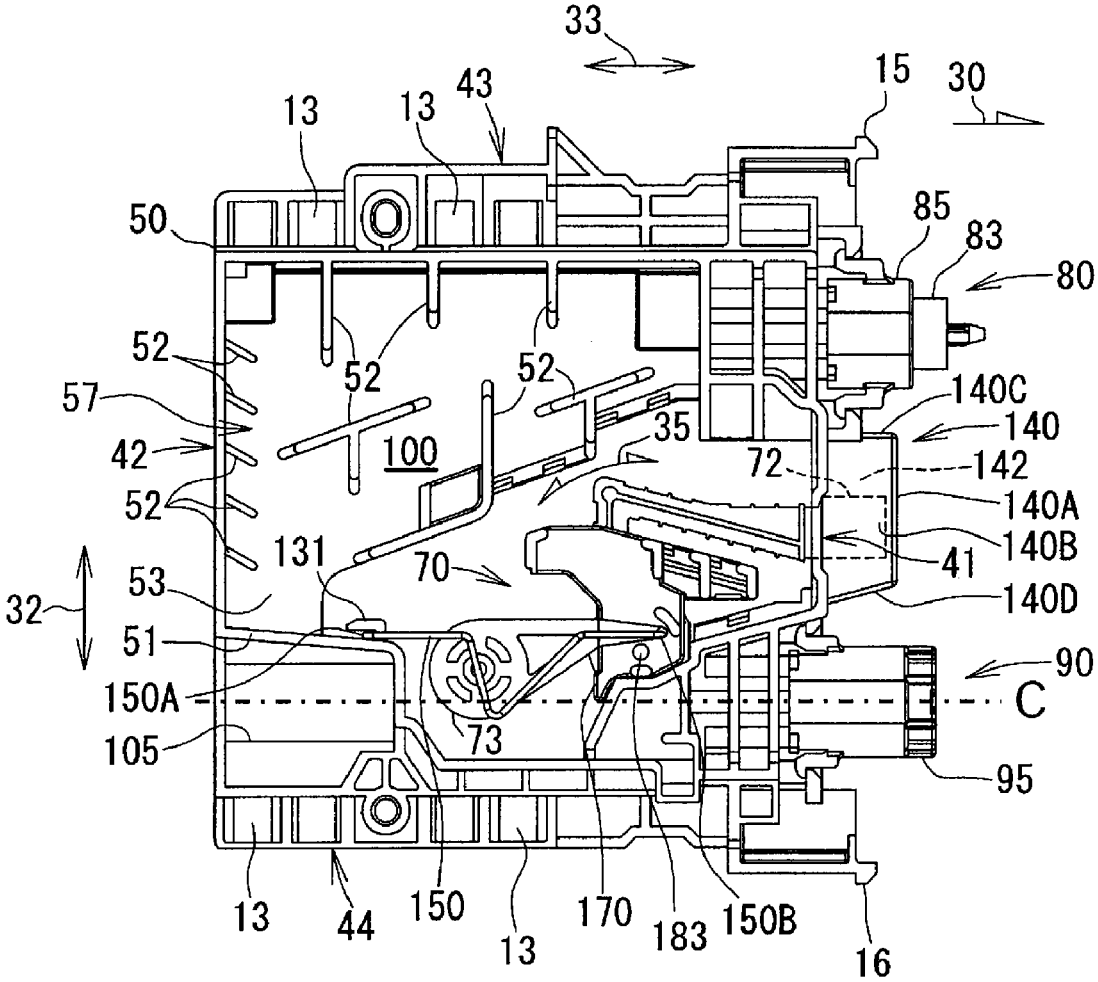
FIG. 5 is a side view of the container body of FIG. 4.
Figure 6:
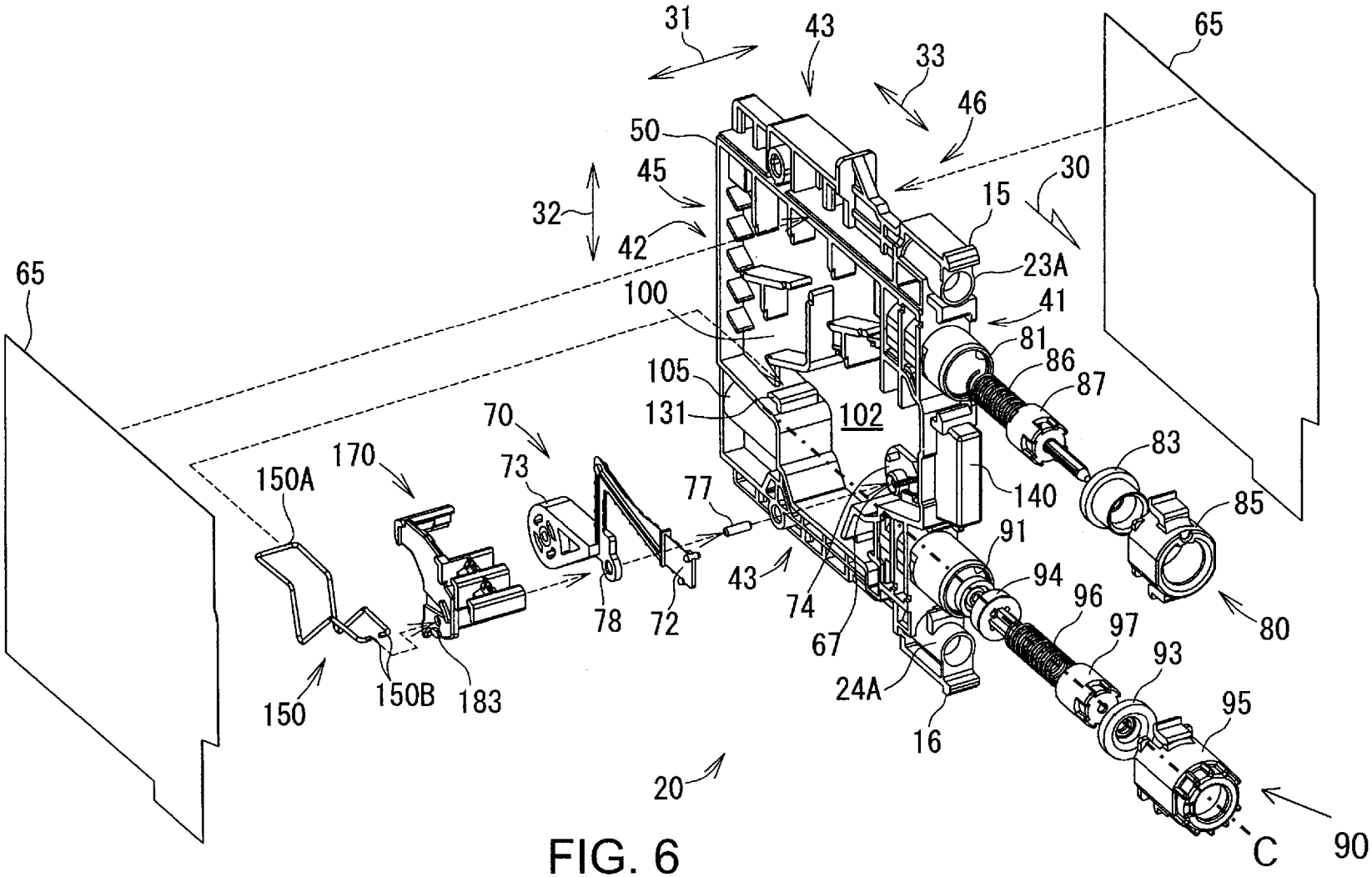
FIG. 6 is an exploded, perspective view of container body of FIG. 4, in which the container body comprises a pair of films.

Referring to FIGS. 5 and 6, the opening 91 has a center line C which is perpendicular to a plane on which the opening 91 is formed. The plane on which the opening 91 is formed may be parallel to the width direction 31 and the height direction 32, and the center line C of the opening 91 may be parallel to the depth direction 33. In another embodiment, the opening 91 may be formed through the bottom face 44, the plane on which the opening 91 is formed may be parallel to the width direction 31 and the depth direction 33, and the center line C of the opening 91 may be parallel to the height direction 32.

Figure 7:
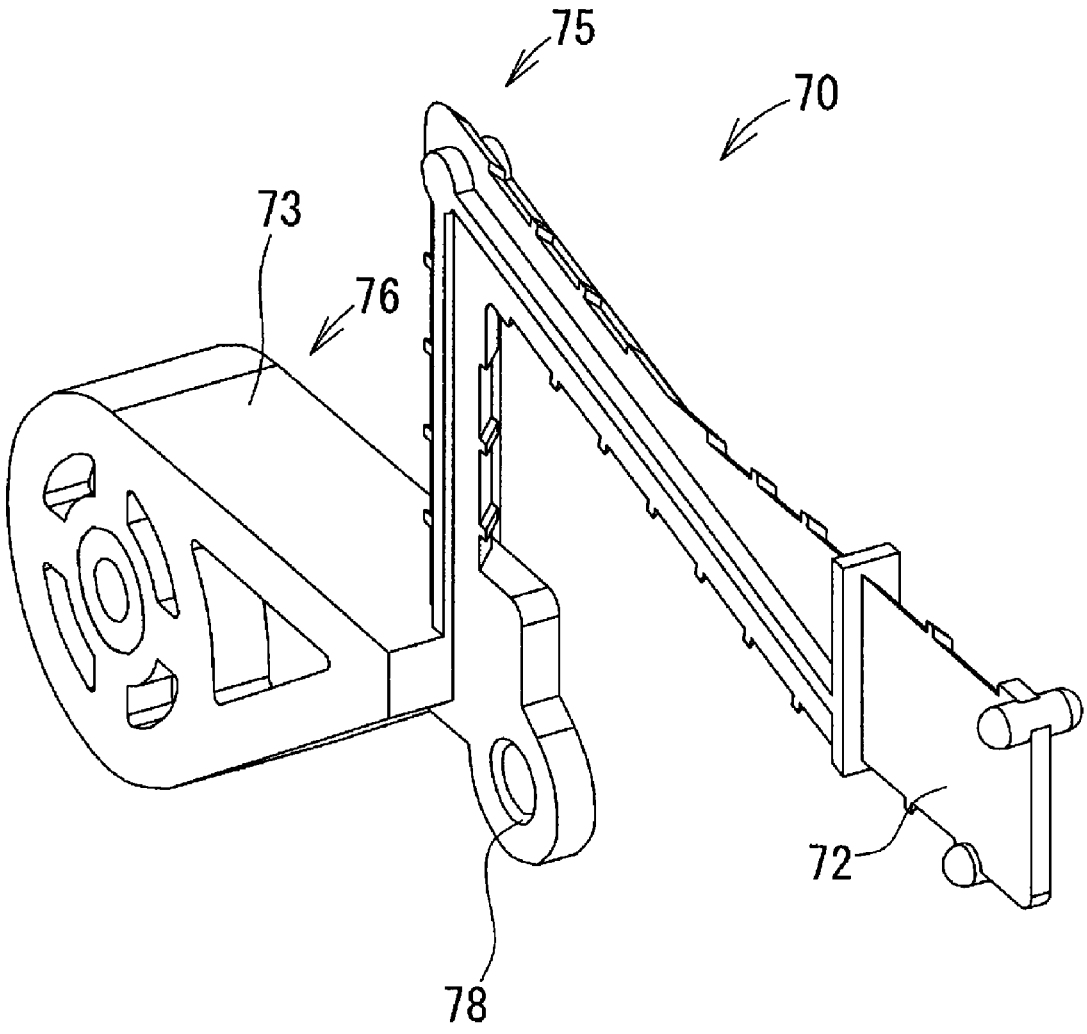
FIG. 7 is a perspective view of a pivotable member, according to an embodiment of the present invention.

Referring to FIGS. 5-7, the pivotable member 70 is configured to indicate whether the ink chamber 100 has a sufficient amount of ink stored therein. The indicating portion 72 is positioned at a first end of the pivotable member 70, and a float portion 73 is positioned at a second end of the pivotable member 70.

The pivotable member 70 has the shaft hole 78 formed therethrough. The shaft hole 78 may be positioned between the first end of the pivotable member and the second end of the pivotable member. The shaft 77 is inserted into the shaft hole 78, and the shaft 77 may support the pivotable member 70, such that the pivotable member 70 pivots about the shaft 77 in a direction indicated by an arrow 35 in FIG. 5. The shaft 77 is supported by the cylindrical tube 67 formed on the rib 74 at one end thereof, and by the supporting block 170 at the other end thereof. Alternatively the shaft 77 may be integral with the pivotable member 70.

The specific gravity of float portion 73 is less than the specific gravity of ink stored in the ink chamber 100. The float portion 73 may have a hollow formed therein, and floats on liquid, such that the float portion 70 moves upward and downward based on the amount of ink within the ink chamber 100, and the pivotable member 70 pivots based on the movement of float portion 73. In another embodiment, the float portion 73 does not have the hollow, and comprises a material having a specific gravity less than the specific gravity of ink.

When the pivotable member 70 pivots clockwise in FIG. 5, the indicating portion 72 contacts the bottom wall 140D of the translucent portion 140, such that further movement of the pivotable member 70 is prevented, and the indicating portion 72 is positioned at the lower position. Similarly, when the pivotable member 70 pivots counterclockwise in FIG. 5, the indicating portion 72 moves away from the bottom wall 140D of the translucent portion 140, and the float portion 73 contacts a bottom surface of the ink chamber 100. When the float portion 73 contacts the bottom surface of the ink chamber 100, further movement of the pivotable member 70 is prevented, and the indicating portion 72 is at the upper position and separated from the bottom wall 140D of the translucent portion 140 by a predetermined distance.

The pivotable member 70 may comprise a first portion 75 extending from the shaft hole 78 to the indicating portion 72, and a second portion 76 extending from the shaft hole 78 to the float portion 73. The mass of the first portion 75 of the pivotable member 70 may be less than the mass of the second portion 76 of the pivotable member 70, such that when the second portion 76 of the pivotable member 70 and the first portion 75 of the pivotable member 70 are in the same medium as each other, the second portion 76 of the pivotable member 70 is heavier than the first portion 75 of the pivotable member 70. Accordingly, when the amount of ink stored in the ink chamber is less than a sufficient amount of ink, the pivotable member 70 pivots counterclockwise about the shaft 77 in FIG. 5, and the indicating portion 72 separates from the bottom wall 140D of the translucent portion 140. When the lower end of the float portion 73 contacts the bottom surface of the ink chamber 100, the pivotable member 70 stops pivoting, and the indicating portion 72 is positioned at the upper position. When the indicating portion 72 is at the upper position, it may be determined that the ink chamber 100 has an insufficient amount of ink stored therein.

In contrast, when a sufficient amount of ink is stored in the ink chamber 100, the float portion 73 is submerged in the ink, and a buoyancy force acts on the float portion 73. The buoyancy force is great enough to cause the pivotable member 70 to pivot clockwise about the shaft 77 in FIG. 5. When the pivotable member 70 pivots clockwise, the indicating portion 72 contacts the bottom wall 140D of the translucent portion 140, and the pivotable member 70 stops pivoting and the indicating portion 72 is positioned at the lower position. When the indicating portion 72 is at the lower position, it may be determined that the ink chamber 100 has a sufficient amount of ink stored therein.

Whether or not the ink chamber 100 has a sufficient amount of ink stored therein may be determined by a user viewing the position of the indicating portion 72 in the inner space 142, or by using an optical sensor e.g., a photo interrupter, to monitor the position of the indicating portion 72.

Referring to FIGS. 5 and 6, the protecting member 150 is positioned around the pivotable member 70. The protecting member 150 may be manufactured by bending a linear steel wire. The protecting member 150 may comprise a U-shaped portion 150A which may be received by a hook 131 formed on the frame 50, and ends 150B of the protecting member 150 may be inserted into a hole (not shown) formed through the rib 74 and a hole 183 formed through the supporting block 170, respectively.

Figure 2:
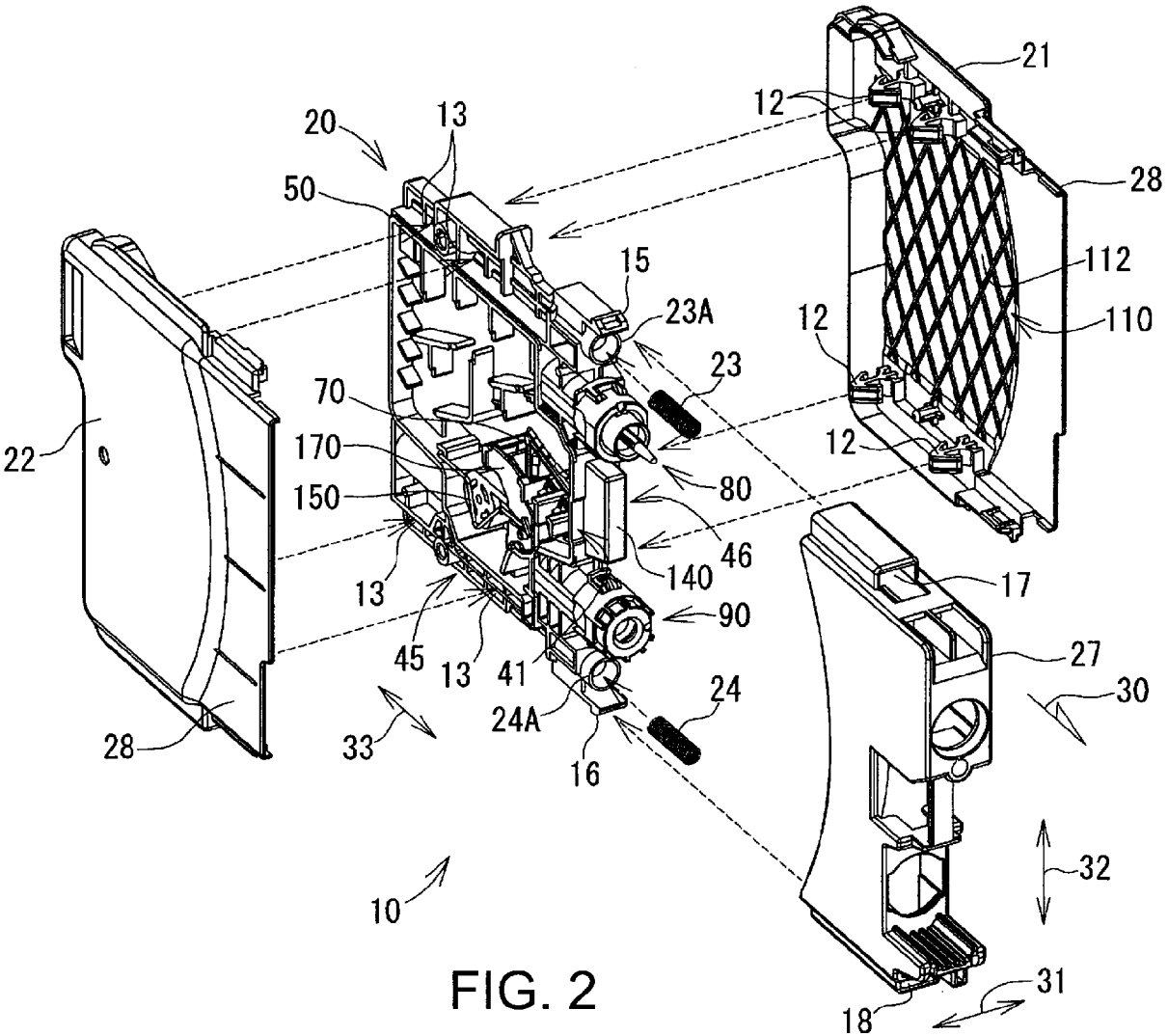
FIG. 2 is an exploded, perspective view of the ink cartridge of FIGS. 1(A) and 1(B).
Figure 8:
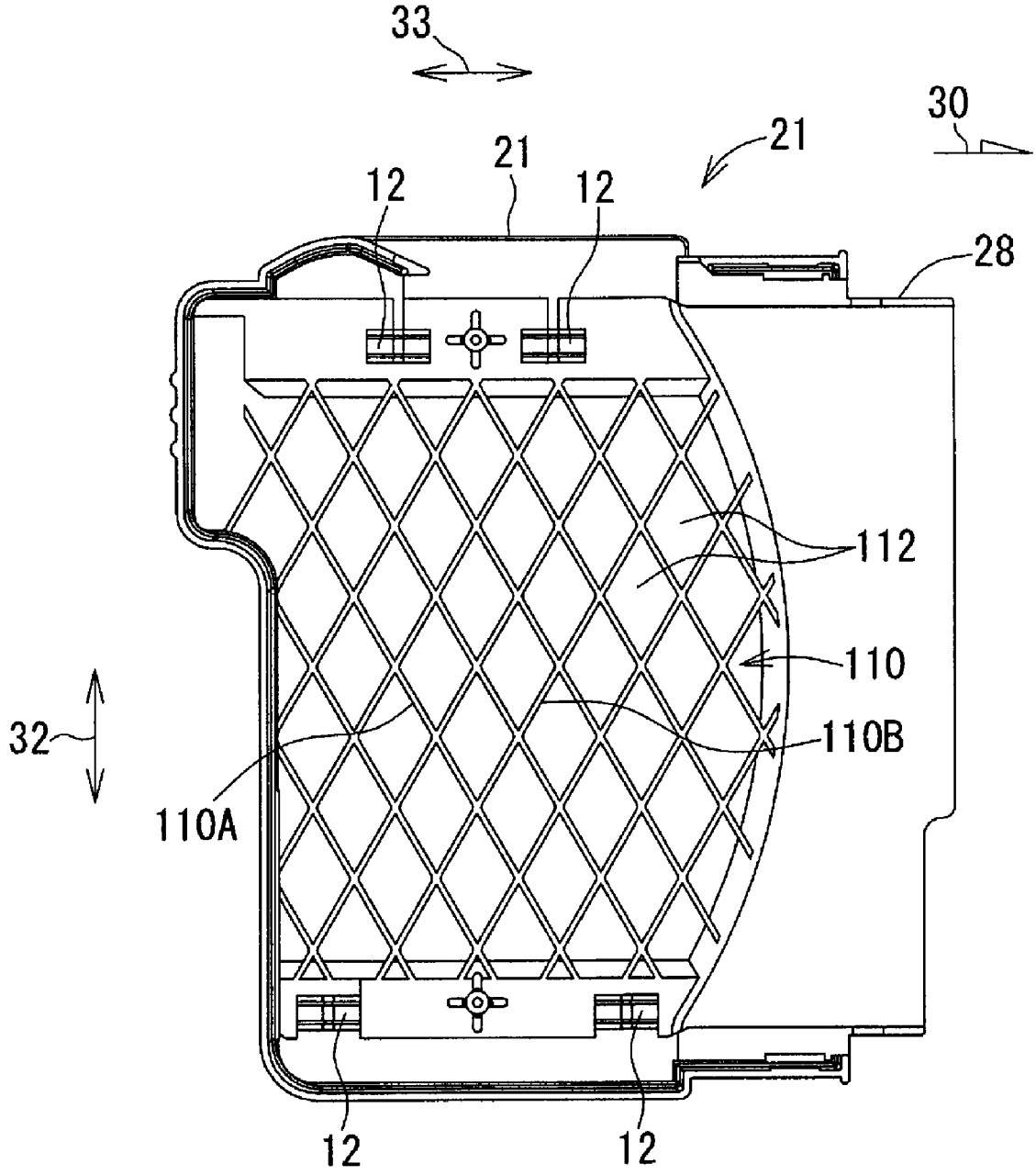
FIG. 8 is a side view of a first cover member, according to an embodiment of the present invention, in which an inner wall surface of the first cover member is depicted.

Referring to FIGS. 2 and 8, an inner wall surface of the first cover member 21 may comprise a first pattern which may face the opening 57 on the right side face 46 of the frame 50. The first pattern may comprise a first portion and a second portion which is raised with respect to the first portion. The first pattern may be a reticulated pattern. The first portion may comprise a flat surface 112, and the second portion may comprise a plurality of rib members 110 which extend from the flat surface 112. The rib members 110 may extend towards the film 65. Each of the rib members 110 has a base connected to the flat surface 112, and a peak positioned away from the flat surface 122. The height of the rib members 110 from the base to the peak may be substantially the same, and, in this embodiment, may be between about 0.2 millimeters and about 0.3 millimeters. The rib members 110 may comprise a plurality of first rib members 110A, and a plurality of second rib members 110B which intersect the first rib members 110A. Each of the first rib members 110A may have a width and a length which is greater than the width, and a distance between a first end of the first rib member 110A and a second end of the first rib member 110A corresponds to the length of the first rib member 110A. A line intersecting a peak of the first end of the first rib member 110A and a peak of the second end of the first rib member 110A may be slanted with respect to the center line C of the opening 91. In another embodiment, the opening 91 may be formed through the bottom face 44 of the frame 50, and a line intersecting a peak of the first end of the first rib member 110A and a peak of the second end of the first rib member 110A may be non-perpendicular with respect to the center line C of the opening 91. Similarly, each of the second rib members 110B may have a width and a length which is greater than the width, and a distance between a first end of the second rib member 110B and a second end of the second rib member 110B corresponds to the length of the second rib member 110B. A line intersecting a peak of the first end of the second rib member 110B and a peak of the second end of the second rib member 110B may be slanted with respect to the center line C of the opening 91. In another embodiment, the opening 91 may be formed through the bottom face 44 of the frame 50, and a line intersecting a peak of the first end of the second rib member 110B and a peak of the second end of the second rib member 110B may be non-perpendicular with respect to the center line C of the opening 91. Each of the first rib members 110A and the second rib members 110B may extend linearly from the first end of the first rib member 110A to the second end of the first rib member 110A, and from the first end of the second rib member 110B to the second end of the second rib member 110B, respectively. Each of the first rib members 110A may extend in a direction which is slanted or non-perpendicular with respect to the center line C of the opening 91, such that a left portion of the first rib member 110A is positioned higher than a right portion of the first rib member 110A in FIG. 8. In contrast, each of the second rib members 110B may extend in a direction which is slanted or non-perpendicular with respect to the center line C of the opening 91, such that a left portion of the first rib member 110B is positioned lower than a right portion of the second rib member 110B. When the container body 20 is positioned, such that the height of the first cover member 21 in the height direction 32 extends substantially parallel to the gravitational direction, the first rib members 110A and the second rib members 110B may extend in directions intersecting a horizontal plane which is perpendicular to the gravitational direction. The first rib members 110A and the second rib members 110B may form a reticulated pattern with rhombs which are longer in the height direction 32 of the first cover member 21. Each of the first rib members 110A and the second rib members 110B may extend from a first end of the ink chamber 100, e.g., an upper end of the ink chamber 100, to a second end of the ink chamber 100, e.g., a lower end of the ink chamber 100. A portion of the rib members 110 may be positioned adjacent to the first end of the ink chamber 100 and distal to the second end of the ink chamber 100, and another portion of the rib members 110 may be positioned adjacent to the second end of the ink chamber 100 and distal to the first end of the ink chamber 100. Moreover, a portion of the rib members 110 may be positioned adjacent to the first end of the ink chamber 100 and distal to the second end of the ink chamber 100, and another portion of the rib members 110 may be positioned substantially at a center of the ink chamber 100. Although it is not shown in the drawings, a plurality of rib members may also be formed on the inner wall surface of the second cover member 22 in the same manner.

When the first cover member 21 is attached to the frame 50, the film 65 positioned on the right side face 46 of the frame 50 and the inner wall surface of the first cover member 21 face each other. If the film 65 is not flexed, the distance between the rib members 110 and the film 65 may be substantially zero, and therefore, the rib members 110 may contact the film 65. When the film 65 is flexed outward, the film 65 may tightly contact the inner wall surface of the first cover member 21, and the first pattern of the inner wall surface of the first cover member 21 may be transferred to the film 65, such that a second pattern corresponding to the first pattern is formed on the film 65. The rib members 110 may contact and apply a force to the film 65, such that the film 65 may be plastically deformed, and projections 60, which correspond to the shape of the rib members 110, may be formed on the surface of the film 65 (See FIG. 10).

Although not shown in the drawings, the inner wall surface of the second cover member 22 also may comprise rib members which are the same as or similar to those on the inner wall surface of the first cover member 21. Therefore, when the film 65 positioned on the left side face 45 tightly contacts the inner wall surface of the second cover member 22, the projections 60 may be formed on the surface of the film 65 positioned on the left side face 45. In another embodiment, the rib members formed on the inner wall surface of the second cover member 22 may have a different shape from the rib members 110 formed on the first cover member 21. In yet another embodiment, when a container-shaped frame having an opening only on the right side face 46 is used instead of the frame 50, the left side face 45 does not have any film, and hence the rib members 110 only may be formed on the inner wall surface of the first cover member 21.

Figure 9:
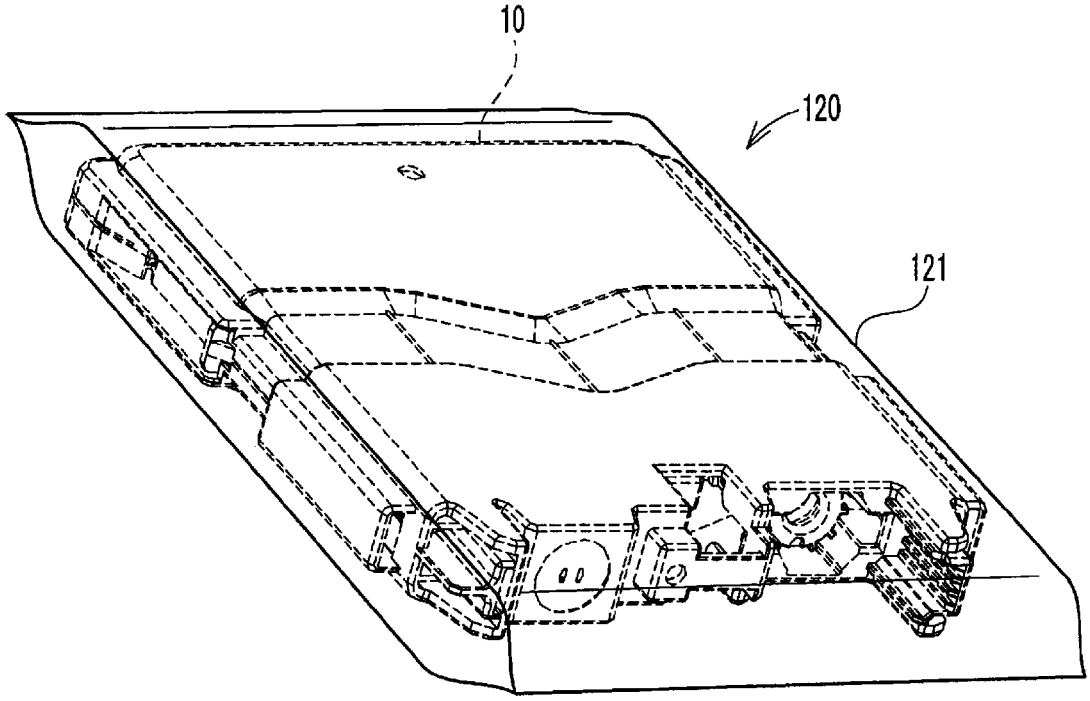
FIG. 9 is a perspective view of a packaging arrangement, according to an embodiment of the present invention.
Figure 10:
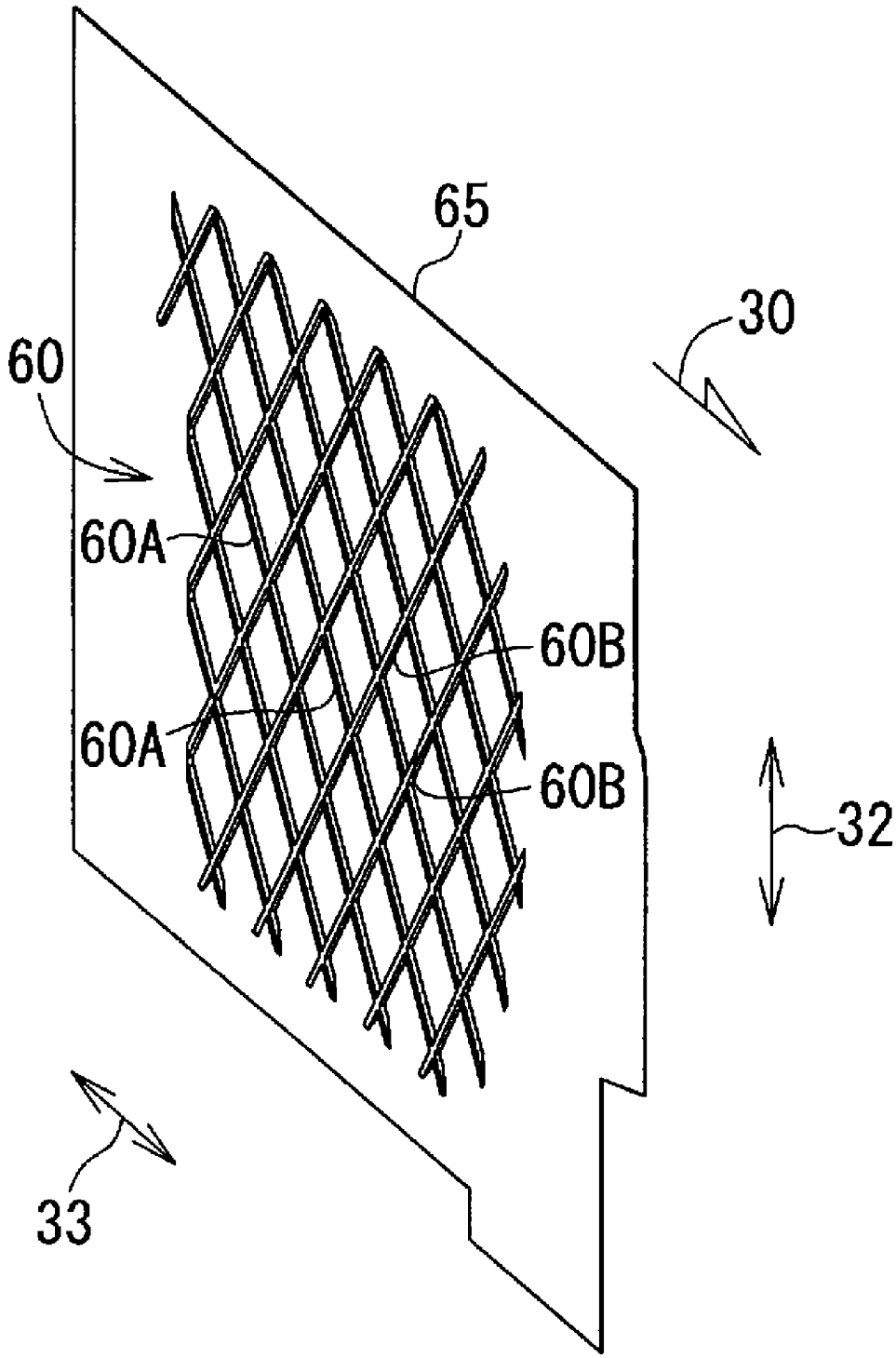
FIG. 10 is a perspective view of a film, according to an embodiment of the present invention, in which projections are formed on the film.

Referring to FIG. 9, a packaging arrangement 120 according to an embodiment of the present invention is depicted. The packaging arrangement 120 may comprise the ink cartridge 10 and a package bag 121 enclosing the ink cartridge 10. The interior of the package bag 121 may be depressurized. When the ink cartridge 10 is shipped from a factory, the packaging arrangement 120 may be stored in a container box.

The interior of the package bag 121 may be depressurized by a suction pump or the like, such that the pressure inside the package bag 121 is less than the atmospheric pressure. The pressure inside the ink chamber 100 also may be depressurized, such that the pressure inside the ink chamber 100 is less than the atmospheric pressure. The pressure inside the package bag 121 and outside the ink chamber 100 may be less than the pressure inside the ink chamber 100. This pressure differential may prevent air from entering the ink chamber 100 through the films 65, such that the pressure inside the ink chamber 100 is prevented from being restored to the atmospheric pressure when the ink cartridge 10 is left unused for a substantial amount of time.

A method of manufacturing the packaging arrangement 120 now is described in detail. Although the following manufacturing steps are described step by step, the order of steps may be changed, or some steps may be performed simultaneously.

The shaft 77, the pivotable member 70, the supporting block 170, and the protecting member 150 may be attached to the frame 50. The pivotable member 70 and the supporting block 170 may be manufactured in advance using injection molding. The pivotable member 70 may be attached to the frame 50, such that the indicating portion 72 is positioned in the inner space 142 of the translucent portion 140. Then, a resilient member, e.g., rubber, may be press-fitted into the ink introduction chamber 105. After the resilient member is fitted in the ink introduction chamber 105, the openings 57 of the frame 50 may be covered and closed by the pair of films 65, respectively, such that the frame 50 and the pair of films 65 define the ink chamber 100 therein. More specifically, after the film 65 is placed on the frame 50 to cover the left side face 45 of the frame 50, the film 65 may be heated and adhered to the left side face 45 of the frame 50 by a thermal adhesion apparatus (not shown). Subsequently, another film 65 may be placed on the frame 50 to cover the right side face 46 of the frame 50, and the film 65 may be heated and adhered to the right side face 46 by the thermal adhesion apparatus.

Subsequently, the air communication valve 80 may be attached to the frame 50 at the opening 81 of the frame 50. More specifically, the spring 86, the valve member 87, the stopper 83, and the cap 85 may be attached to the frame at the opening 81 of the frame 50. Similarly, the ink supply valve 90 may be attached to the frame 50 at the opening 91 of the frame 50. More specifically, the spring receiver 94, the spring 96, the valve member 97, the stopper 93, and cap 95 may be attached to the frame 50 at the opening 91 of the frame 50. When the openings 81 and 91 are closed by the air communication valve 80 and the ink supply valve 90, respectively, the ink chamber 100 may be sealed from the exterior of the ink chamber 100.

Subsequently, air in the ink chamber 100 may be discharged through the opening 91. More specifically, a suction tube of a decompression device (not shown) may be inserted into the opening 91, such that the suction tube applies a force to the ink supply valve 90 to open the opening 91. Then, the decompression device may be activated to draw the air from the ink chamber 100. When the air in the ink chamber 100 is drawn by the decompression device, and the pressure inside the ink chamber 100 is lowered to a predetermined pressure, the decompression device may be stopped, and the suction tube may be removed from the opening 91. When the suction tube is removed from the opening 91, the opening 91 may be closed by the ink supply valve 90. Therefore, the interior of the ink chamber 100 may be maintained in a depressurized state.

After the interior of the ink chamber 100 is depressurized, an ink introduction needle may be inserted into the ink chamber 100 through the resilient member fitted in the ink introduction chamber 105 to introduce ink into the ink chamber 100. Because the interior of the ink chamber 100 is depressurized, ink readily may be introduced into the ink chamber 100 by the pressure differential between the interior and the exterior of the ink chamber 100. After a predetermined amount of ink has been introduced into the ink chamber 100, e.g., about 80% the capacity of the ink chamber 100, the ink introduction needle may be removed from the resilient member. When the ink introduction needle is inserted through the resilient member and then removed, an opening formed through the resilient member by the ink introduction needle may be closed by the resiliency of the resilient member. In this embodiment, after ink is introduced into the ink chamber 100, the pressure inside the ink chamber 100 may be about −60 kPa. The films 65 may be caused to flex toward the ink chamber 100 by the pressure differential between the interior and the exterior of the ink chamber 100. Nevertheless, the supporting block 170 may support the films 65 from the interior of the ink chamber 100.

Subsequently, the housing 26 may be attached to the frame 50. More specifically, the first cover member 21 may be attached to the right side face 46 of the frame 50, and the second cover member 22 may be attached to the left side face 45 of the frame 50. Consequently, the first cover member 21 may be positioned outside the film 65 which closes the right side face 46 of the frame 50, and the second cover member 22 may be positioned outside the film 65 which closes the left side face 45 of the frame 50. The films 65 may flex inwardly because the interior of the ink chamber 100 is depressurized, and therefore, in this embodiment, the films 65 may be positioned at a distance of about 0.3 millimeters at maximum apart from the cover members 21 and 22, respectively. Subsequently, the slider 27 may be coupled to the container body 20 via the coil springs 23 and 24.

Subsequently, the ink cartridge 10 may be positioned in the package bag 121 through an opening of the package bag 121, and then a portion of the opening of the package bag 121 may be closed by adhering the edge of the opening, such that a part of the opening is not closed. Then, the suction tube of the decompression device may be inserted into the package bag 121 through the unclosed part of the opening, and the decompression device may be activated to discharge air from the package bag 121. Then, in this embodiment, after the pressure in the package bag 121 is reduced to be about −70 kPa, the suction tube may be removed, and the unclosed part of the opening may be closed by adhering the edge of the unclosed part of the opening. The pressure outside the ink chamber 100 and inside the package bag 121 may be about 10 kPa less than the pressure inside the ink chamber 100. In another embodiment, the pressure inside the package bag 121 and outside the ink chamber 100 may be at least 2 kPa less than the pressure inside the ink chamber 100.

When the ink cartridge 10 is packaged in the package bag 121 in this manner, the pressure differential between the interior and the exterior of the ink chamber 100 draws the film 65, which closes the right side face 46 of the frame 50, into tight contact with the inner wall surface of the first cover member 21. Consequently, the rib members 110 may contact and apply a force to the film 65 to deform the film 65 plastically, such that the projections 60 which correspond to the shape of the rib members 110 are formed on the surface of the film 65. The film 65 may remain in tight contact with the inner wall surface of the first cover member 21 at least until the package bag 121 is opened. The projections 60 may be formed after the packaging arrangement 120 is manufactured and before a user opens the package bag 121 to use the ink cartridge 10. The projections 60 also may be formed on the surface of the film 65 which closes the left side face 45 of the frame 50 in the same manner.

As descried above, the rib members 110 may comprise the first rib members 110A and the second rib members 110B. Therefore, referring to FIG. 10, the projections 60 on the film 65 may comprise a plurality of first projections 60A which correspond to the first rib members 110A, and a plurality of second projections 60B which correspond to the second rib members 110B. Each of the first and the second projections 60A and 60B may be raised from a flat surface of the film 65 to extend into the ink chamber 100. Each of the projections 60 has a base connected to the flat surface of the film 65, and a peak positioned away from the flat surface of the film 65. The height of the projections 60 from the base to the peak may be substantially the same, and, in this embodiment, may be between about 0.2 millimeters and about 0.3 millimeters. The first projections 60A may intersect the second projections 60B. Each of the first projections 60A has a width and a length which is greater than the width, and a distance between a first end of the first projection 60A and a second end of the first projection 60A corresponds to the length of the first projection 60A. A line intersecting a peak of the first end of the first projection 60A and a peak of the second end of the first projection 60A may be slanted with respect to the center line C of the opening 91. In another embodiment, the opening 91 may be formed through the bottom face 44 of the frame 50, and a line intersecting a peak of the first end of the first projection 60A and a peak of the second end of the first projection 60A may be non-perpendicular with respect to the center line C of the opening 91. Similarly, each of the second projection 60B may have a width and a length which is greater than the width, and a distance between a first end of the second projection 60B and a second end of the second projection 60B corresponds to the length of the second projection 60B. A line intersecting a peak of the first end of the second projection 60B and a peak of the second end of the second projection 60B may be slanted with respect to the center line C of the opening 91. In another embodiment, the opening 91 may be formed through the bottom face 44 of the frame 50, and a line intersecting a peak of the first end of the second projection 60B and a peak of the second end of the second projection 60B may be non-perpendicular with respect to the center line C of the opening 91. Each of the first projections 60A and the second projections 60B may extend linearly from the first end of the first projection 60A to the second end of the first projection 60A, and from the first end of the second projection 60B to the second end of the second projection 60B, respectively. Each of the first projections 60A may extend in a direction which is slanted or non-perpendicular with respect to the center line C of the opening 91, such that a left portion of the first projection 60A is positioned higher than a right portion of the first projection 60A in FIG. 10. In contrast, each of the second projections 60B may extend in a direction which is slanted or non-perpendicular with respect to the center line C of the opening 91, such that a left portion of the second projection 60B is positioned lower than a right portion of the second projection 60B. When the container body 20 is positioned, such that the height of the ink cartridge 10 extends substantially parallel to the gravitational direction, the first projections 60A and the second projections 60B may extend in directions intersecting a horizontal plane which is perpendicular to the gravitational direction. The first projections 60A and the second projections 60B may form a reticulated pattern with rhombs which are longer in the height direction 32 of the ink cartridge 10. Each of the first projections 60A and the second projections 60B may extend from a first end of the ink chamber 100, e.g., an upper end of the ink chamber 100, to a second end of the ink chamber 100, e.g., a lower end of the ink chamber 100. A portion of the projections 60 may be positioned adjacent to the first end of the ink chamber 100 and distal to the second end of the ink chamber 100, and another portion of the projections 60 may be positioned adjacent to the second end of the ink chamber 100 and distal to the first end of the ink chamber 100. Moreover, a portion of the projections 60 may be positioned adjacent to the first end of the ink chamber 100 and distal to the second end of the ink chamber 100, and another portion of the projections 60 may be positioned substantially at a center of the ink chamber 100. The directions in which the first projections 60A and the second projections 60B extend may be selected based on the wettability of the surface of the films 65 on the ink-chamber-100 side.

The container body 20 may comprise the projections 60 formed on the films 65 and extending in a direction intersecting the horizontal plane when the container body 20 is positioned, such that the height of the ink cartridge 10 extends substantially parallel to the gravitational direction, e.g., when the ink cartridge 10 is mounted to an image recording apparatus. Therefore, ink droplets on the film 65 run downward in the ink chamber 100 along the projections 60, and are supplied to the image recording apparatus through the opening 91. Accordingly, ink may be consumed efficiently.

The float portion 73 may move based on the amount of ink in the ink chamber 100. Because the ink in the ink chamber 100 runs downward along the projections 60, the float portion 73 readily may move based on the amount of ink in the ink chamber 100. Therefore, an ink amount determination may be accurately performed.

Figure 11:
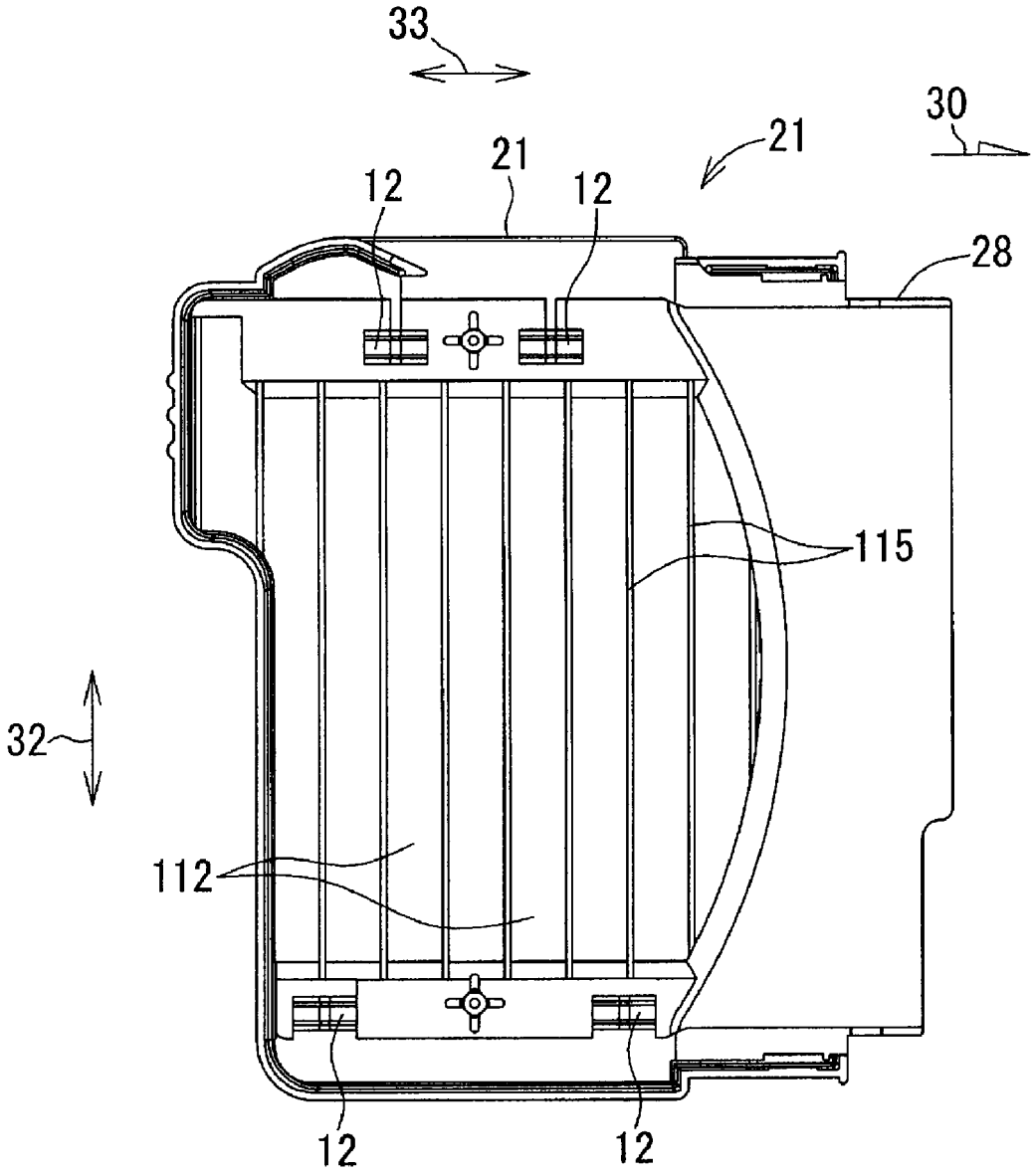
FIG. 11 is a side view of a first cover member, according to another embodiment of the present invention, in which an inner wall surface of the first cover member is depicted.

Referring to FIG. 11, the inner wall surface of the first cover member 21 may comprise a third pattern according to another embodiment of the present invention. The third pattern may comprise a first portion and a second portion which is raised with respect to the first portion. The first portion may comprise a flat surface 112, and the second portion may comprise a plurality of rib members 115 which extend from the flat surface 112. The rib members 115 may extend in the height direction 32 of the first cover member 21. The rib members 115 may be positioned side by side in a horizontal direction, which is parallel to the depth direction 33. When the ink cartridge 10 is packaged in the package bag 121 and the interior of the package bag 121 is depressurized as described above, the third pattern may be transferred to the film 65 positioned on the right side face 46, such that a fourth pattern corresponding to the third pattern is formed on the film 65. The rib members 110 may contact and apply a force to the film 65, such that the film 65 are plastically deformed, and projections (not shown) corresponding to the rib members 115 may be formed on the film 65. The projections on the film 65 may extend perpendicular to the horizontal plane from an upper end of the ink chamber 100 to a lower end of the ink chamber 100. Projections also may be formed on the surface of the film 65 which closes the left side face 45 of the frame 50 in the same manner.

Figure 12:
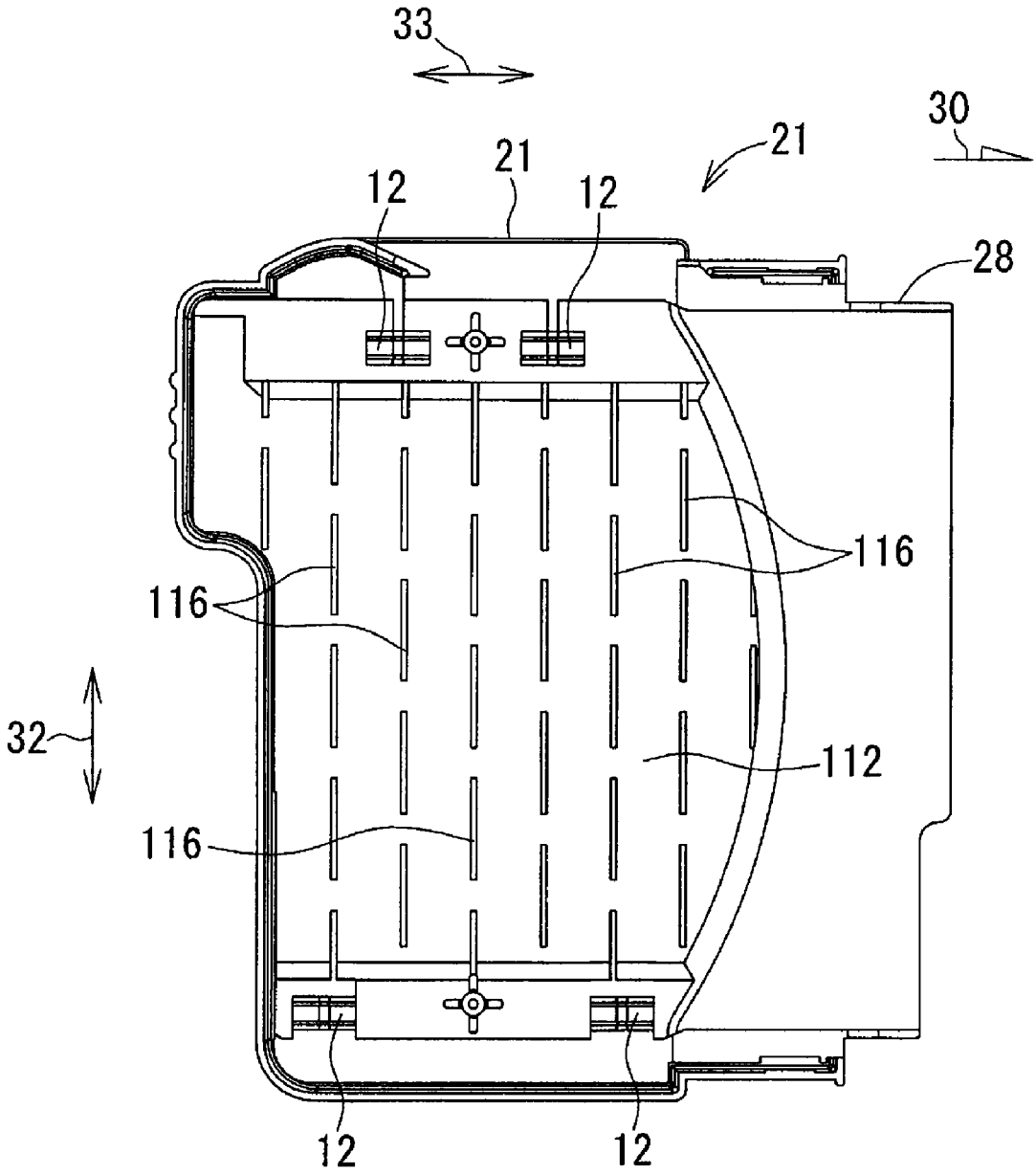
FIG. 12 is a side view of a first cover member, according to yet another embodiment of the present invention, in which an inner wall surface of the first cover member is depicted.

Referring to FIG. 12, the inner wall surface of the first cover member 21 may comprise a fifth pattern according to yet another embodiment of the present invention. The fifth pattern may comprise a first portion and a second portion which is raised with respect to the first portion. The first portion may comprise a flat surface 112, and the second portion may comprise a plurality of rib members 116 which extend from the flat surface 112. The rib members 116 may extend in the height direction 32 of the first cover member 21 at predetermined intervals in the height direction 32. A length of each of the rib members 116 may be less than the height of the opening 57 in the height direction 32. The rib members 116 may be positioned in row in the height direction 32. The rib members 116 also may be positioned side by side in a horizontal direction, which is parallel to the depth direction 33. When the ink cartridge 10 is packaged in the package bag 121 and the interior of the package bag 121 is depressurized as described above, the fifth pattern may be transferred to the film 65 positioned on the right side face 46, such that a sixth pattern corresponding to the fifth pattern is formed on the film 65. The rib members 116 may contact and apply a force to the film 65, such that the film 65 are plastically deformed, and projections (not shown) corresponding to the rib members 116 may be formed on the film 65. One of the projections may be positioned adjacent to the upper end of the ink chamber 100 and distal to the lower end of the ink chamber 100, another one of the projections may be positioned adjacent to the lower end of the ink chamber 100 and distal to the upper end of the ink chamber 100, and yet another one of the projections may be positioned substantially at a center of the ink chamber 100. Projections also may be formed on the surface of the film 65 which closes the left side face 45 of the frame 50 in the same manner.

Figure 13:
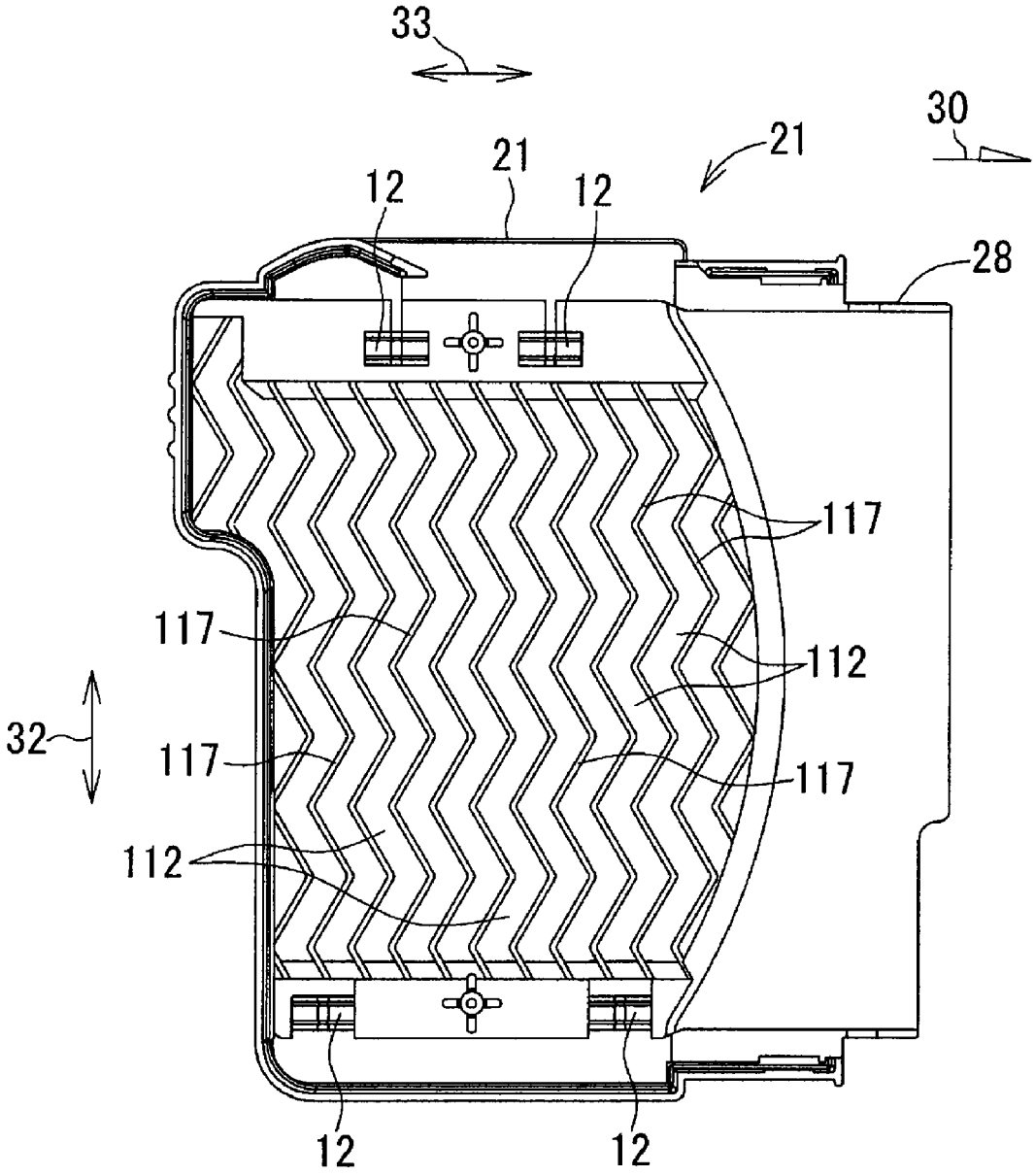
FIG. 13 is a side view of a first cover member, according to still another embodiment of the present invention, in which an inner wall surface of the first cover member is depicted.

Referring to FIG. 13, the inner wall surface of the first cover member 21 may comprise a seventh pattern according to still another embodiment of the present invention. The seventh pattern may comprise a first portion and a second portion which is raised with respect to the first portion. The first portion may comprise a flat surface 112, and the second portion may comprise a plurality of rib members 117 which extend from the flat surface 112. The ribs 75 may extend from the upper end of the ink chamber 100 to a lower end of the ink chamber 100 in zigzag patterns. The rib members 117 may be positioned side by side in a horizontal direction, which is parallel to the depth direction 33. When the ink cartridge 10 is packaged in the package bag 121 and the interior of the package bag 121 is depressurized as described above, the seventh pattern may be transferred to the film 65 on the right side face 46, such that a eighth pattern corresponding to the seventh pattern is formed on the film 65. The rib members 117 may contact and apply a force to the film 65, such that the film 65 are plastically deformed, and projections (not shown) corresponding to the rib members 116 may be formed on the film 65. Projections also may be formed on the surface of the film 65 which closes the left side face 45 of the frame 50 in the same manner.

In another embodiment, the inner wall surface of the first cover member 21 or the second cover member 22 may comprise a ninth pattern. The ninth pattern may comprise a first portion and a second portion which is raised with respect to the first portion. The second portion may comprise a flat surface 112, and the first portion may comprise a plurality of grooves recessed in the direction away from the film 65. When the ink cartridge 10 is packaged in the package bag 121 and the interior of the package bag 121 is depressurized, the ninth pattern may be transferred to the film 65, such that a tenth pattern corresponding to the ninth pattern is formed on the film 65. An inner surface of the grooves may contact and apply a force to the film 65, such that the film 65 are plastically deformed, and projections (not shown) corresponding to the grooves may be formed on the film 65. The projections may extend away from the ink chamber 100.

In another embodiment, the projections 60 may be formed on the film 65 before the film 65 is adhered to the frame 50. Nevertheless, it may be more difficult to adhere the film 65 to the frame 50 if the projections 60 are formed on the film 65 in advance because the film 65 may be at least partially deformed due to the projections 60.

In another embodiment, the pivotable member 70 may be omitted.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or from a practice of the invention disclosed herein. It is intended that the specification and the described examples are consider exemplary only, with the true scope of the invention indicated by the following claims.

What is claimed is:

1. A method for manufacturing an ink cartridge comprising the steps of:

connecting at least one film to a frame, wherein the at least one film and the frame define an ink chamber therein, and the ink cartridge comprises the at least one film and the frame;

positioning a patterned member adjacent to the at least one film, wherein the patterned member comprises a first pattern, and the first pattern comprises a first portion and a second portion which is raised with respect to the first portion; and forming a second pattern corresponding to the first pattern on the at least one film by generating a pressure differential between a pressure inside the ink chamber and a pressure outside the ink chamber, wherein the pressure differential draws the at least one film into contact with at least a portion of the first pattern, and wherein the step of forming the second pattern comprises the substep of reducing the pressure outside the ink chamber.

2. The method of claim 1, wherein the patterned member comprises a cover member configured to cover the at least one film.

3. The method of claim 2, wherein the second portion comprises a plurality of rib members which extend from the cover member.

4. The method of claim 3, wherein when the pressure differential draws the at least one film into contact with at least a portion of the first pattern, the plurality of rib members contact and apply a force to the at least one film to form the second pattern in the at least one film.

5. The method of claim 2, wherein the first portion comprises a plurality of grooves which are formed in the cover member.

6. The method of claim 5, wherein when the pressure differential draws the at least one film into contact with at least a portion of the first pattern, an inner surface of the plurality of grooves contact and apply a force to the at least one film to form the second pattern in the at least one film.

7. The method of claim 1, further comprising the steps of:

discharging air from the ink chamber prior to forming the second pattern; and introducing ink into the ink chamber after discharging air from the ink chamber and prior to forming the second pattern.

8. The method of claim 7 further comprising the step of positioning the ink cartridge in a packaging member after introducing the ink into the ink chamber and prior to forming the second pattern, wherein the step of forming the second pattern comprises the substep of reducing the pressure outside the ink chamber to be less than the pressure inside the ink chamber.

9. The method of claim 1, further comprising the step of positioning the ink cartridge in a packaging member prior to forming the second pattern, wherein the step of forming the second pattern comprises the substep of reducing the pressure outside the ink chamber to be less than the pressure inside the ink chamber.

* * * * *